US006220483B1

(12) United States Patent
van der Heijden

(10) Patent No.: US 6,220,483 B1
(45) Date of Patent: Apr. 24, 2001

(54) DISPENSING ASSEMBLY FOR DISPENSING TWO LIQUID COMPONENTS

(75) Inventor: Edgar Ivo Maria van der Heijden, Alkmaar (NL)

(73) Assignee: Airspray International B.V. (NL)

( * ) Notice: Subject to any disclaimer, the term of this patent is extended or adjusted under 35 U.S.C. 154(b) by 0 days.

(21) Appl. No.: 09/362,769

(22) Filed: Jul. 28, 1999

Related U.S. Application Data

(63) Continuation of application No. PCT/NL97/00645, filed on Nov. 25, 1997.

(30) Foreign Application Priority Data

Feb. 5, 1997 (NL) ..... 1005189

(51) Int. Cl.[7] ..... B67D 5/52

(52) U.S. Cl. ..... 222/136; 222/145.5; 222/321.2; 222/321.4; 222/321.7

(58) Field of Search ..... 222/135, 136, 222/145.3, 145.5, 321.2, 321.4, 321.7, 321.9, 385

(56) References Cited

U.S. PATENT DOCUMENTS 4,277,001 * 7/1981 Nozawa ..... 222/321.4
4,402,432 * 9/1983 Corsette ..... 222/321.2
4,438,871 3/1984 Eckert ..... 222/137
5,351,862 10/1994 Weag ..... 222/145
5,752,626 * 5/1998 Bachand ..... 222/136
6,053,368 * 4/2000 Geimer ..... 222/321.7
6,082,588 * 7/2000 Markey et al. ..... 222/136

FOREIGN PATENT DOCUMENTS

WO 93/04940 3/1993 (WO) .

* cited by examiner

*Primary Examiner*—Joseph A. Kaufman
(74) *Attorney, Agent, or Firm*—Hoffman & Baron, LLP

(57) ABSTRACT

Dispensing assembly for dispensing two liquid components, comprising an outer piston pump concentric with an inner piston pump provided with resetting means, in which the inlet and outlet of the piston chambers comprise pre-tensioned non-return valves, in which the inner piston has a small free stroke relative to the other parts of the assembly, a stationary stroke limiting part with a stop is present in the outer piston chamber of the outer piston pump, which stroke limiting part under friction can interact with a stop on the inner piston, in order to limit the movement distance thereof and permit the movement thereof only under friction, and the outer piston and the inner piston comprise carrier bevelled collars which can interact in a sealing manner with each other and form an active non-return valve for the outlet of the outer piston chamber.

12 Claims, 4 Drawing Sheets

DISPENSING ASSEMBLY FOR DISPENSING TWO LIQUID COMPONENTS

CROSS-REFERENCE TO RELATED APPLICATIONS

This is a continuation application of PCT/NL97/00645 filed Nov. 25, 1997.

FIELD OF THE INVENTION

The present invention relates to a dispensing assembly for dispensing two liquid components, comprising an outer piston pump concentric with an inner piston pump for the components to be dispensed, with a common control part, which piston pumps are provided with resetting means and each comprise a piston chamber with a piston and an inlet and an outlet, which outlet can be placed in communication with an outflow opening, with the interposition of a non-return valve under pre-tension, and which inlet can be placed in communication with a source for component to be dispensed, with the interposition of a non-return valve, while the pistons of the piston pumps comprise a channel for conveying the liquid component in question to an outflow opening.

BACKGROUND OF THE INVENTION

Such dispensing assemblies with so-called double, concentric pumps are generally known in the prior art and are used for dispensing many kinds of liquid components from containers. Such liquid components are not particularly limited and vary from aqueous liquid components to paste-like materials.

Examples of components to be dispensed are, for example, adhesives with a hardener, paints with a hardener, cosmetic products with reactive components, detergents with reactive components etc.

The ratio between the quantities of the components to be dispensed can be set as desired by a suitable choice of the dimensions of the parts in question.

The outflow openings for the components in question can be in the form of individual outflow openings, but they can also be in the form of a common outflow opening, with the interposition of a mixing chamber section or otherwise.

All known dispensing assemblies have the major disadvantage that partial vacuum possibly occurring outside the outflow opening causes an inadequate seal to be obtained between the concentric inner and outer piston. This can occur, for example, in an aircraft. In that case, material may be sucked out of the outer piston chamber, through between the pistons, and consequently out of the container for the particular component which may be connected to the outlet of the outer piston chamber, and out of the outflow opening. This is, of course, undesirable. Constituents are in fact often dispensed with such dispensing assemblies in practice, which are sticky after drying or otherwise. When there is accidental outflow of such constituents, the subsequent functioning of the dispensing assembly may be seriously impeded, if not rendered impossible.

The control part used in the case of such dispensing assemblies is generally a push-button on the dispensing assembly, which push-button interacts with both pumps. It is undesirable for said button to be soiled with material for dispensing, since a user operates the dispensing assembly by pressing with a finger on the push-button.

Moreover, the entire assembly is often shut off by a sealing cap or sealing cover, which can also be undesirably soiled by the abovementioned escaping component.

SUMMARY OF THE INVENTION

The object of the present invention is to provide a solution to the abovementioned problems, and to that end the invention is characterized in that the inner piston pump comprises an inner piston which has a small free stroke relative to the other parts of the assembly, in that a stationary stroke limiting part with a stop is present in the outer piston chamber of the outer piston pump, which stroke limiting part under friction can interact with a stop on the inner piston, in order to limit the movement distance thereof and permit the movement thereof only under friction, and in that the outer piston and the inner piston comprise carrier means which can interact in a sealing manner with each other and form an active non-return valve for the outlet of the outer piston chamber, all the above in such a way that when there is a resetting movement the outer piston can carry along the inner piston and seal the connection between the outer piston chamber and an outflow opening.

Owing to the small free stroke of the inner piston and the presence of the carrier means, an excellent seal is obtained between the outer piston and the inner piston, which ensures that no material can be sucked through between the pistons if a partial vacuum occurs. In other words, the non-return valve in the outlet of the outer piston chamber is formed by the carrier means mentioned earlier. Unlike many non-return valves used in the prior art, said non-return valve is an active non-return valve, and not a passive one. A partial vacuum outside the dispensing assembly, i.e. outside the outflow opening, also promotes the sealing action of said non-return valve. All the above will be explained in greater detail further on, in the description of the drawings.

In a special embodiment of the dispensing assembly according to the invention, the stationary stroke limiting part defines an annular intermediate piston chamber which by way of one or more narrow passages is in communication with the outer piston chamber, and the stop on the inner piston forms an intermediate piston in the intermediate piston chamber.

When the dispensing assembly is being used, the intermediate piston chamber will be filled through the narrow openings with component from the outer piston chamber, so that on movement of the inner piston a damping of the movement thereof will be obtained, which has a very advantageous influence on the operation of the entire dispensing assembly. This in fact means that when the assembly makes a dispensing stroke the active non-return valve formed by the carrier means is opened in a reliable manner.

In particular, the limiting part is formed by a bush fixed on the inner piston chamber and having on one end an inward directed collar which can interact with the intermediate piston, in which case by grooves and/or ribs on either the inside wall of the bush or the outside wall of the inner piston chamber, or both, one or more passages are formed, so that the intermediate piston chamber is in communication with the outer piston chamber. This advantageous embodiment will be explained in greater detail further on, in the description of the drawings.

In the case of many dispensing assemblies, in particular dispensing assemblies for components with relatively low viscosity, there is a so-called start-up problem, in other words, when the assembly is being used for the first time it takes some time before material can actually be dispensed, and the user has to press the dispensing assembly several times, sometimes even more than 25 times, before the components can be dispensed.

In order to solve this problem, according to the invention, at least the inner piston chamber is filled with a start-up agent prior to a first use of a dispensing assembly.

A start-up agent is also known as a primer and serves to ensure that the assembly can operate and dispense material already at the first service stroke. An example of a suitable primer is glycerol. The viscosity of the primer is preferably slightly higher than that of the material to be pumped. Of course, the primer ultimately to be used will depend on the material to be dispensed. The primer is preferably inert relative to the material to be dispensed.

The carrier means on the inner piston and the outer piston are advantageously designed in the form of sealing collars on said pistons, which collars are bevelled in the same direction and fit into each other. Using suitably bevelled sealing collars on the pistons ensures that when there is a resetting movement of the outer piston, a very good seal supported by external partial vacuum is obtained between the two pistons.

The friction action between the stroke limiting part and the inner piston can be carried out in many different ways. For instance, the mutual dimensions of the parts in question can be selected in such a way that friction is obtained. However, it is advantageous if the outside wall of the inner piston is provided locally with friction ribs which extend in the intended direction of movement of the inner piston, but are situated at a distance from the stop thereof, which distance is equal to or greater than the axial distance of the stop from the stroke limiting part. All the above will be explained in greater detail in the description of the figures. The material of the inner piston is generally a relatively soft plastic material, and the stroke limiting part is often made of a harder, more rigid plastic. By not providing the ribs over the entire outside wall of the inner piston, it is ensured that relaxation (creep) of the material of the inner piston does not cause the necessary friction to decrease, or even disappear, after some time, prior to use for the first time. Instead of or in addition to the above, friction ribs can also be present on the inside wall of the stroke limiting part, which friction ribs extend in the intended direction of movement of the inner piston, but are situated at a distance from the stop thereof, which distance is equal to or greater than the axial thickness of the intermediate piston near the inside wall of the stroke limiting part, all the above being for the same reasons as those in the case of the friction ribs mentioned earlier.

The inner piston has a small free stroke, and said free stroke is in particular such that it is just sufficient to be able to release the carrier means on the inner piston and the outer piston and open the communication between the outer piston chamber and a dispensing opening.

The non-return valve in the outlet of the inner piston chamber is advantageously designed in the form of a non-return valve with a ball pre-tensioned by a spring in a seat.

In addition to the above valve, or instead thereof, the inner piston, which relative to the other parts of the assembly has a small free stroke at the outflow end, comprises a valve which is preferably pre-tensioned in the outflow direction, which valve can be opened by interaction with the control part. It is particularly preferable for said outflow end of the inner piston to comprise an inward directed collar which forms a seat for a ball present in the piston, which ball is held in the seat by a spring, and the control part comprises a bar-shaped part which during the dispensing of material can press the ball off the seat against the action of the spring. All the above will be explained in greater detail in the description of the figures. The spring used in the case of this non-return valve is preferably a spring with a relatively low spring force, which is just sufficient to hold the ball in the seat. It must be ensured that at the start of dispensing, i.e. at the moment at which the control part of the dispensing assembly is operated, said non-return valve is opened first. It is particularly advantageous for the abovementioned spring also to serve as a pre-tensioning means for the ball of the non-return valve in the outlet of the inner piston chamber, in other words, the spring is a dual-action spring for providing pre-tension on two non-return valves in the outlet of the inner piston chamber.

The invention also relates to an aerosol comprising two compartments for components and a dispensing assembly, characterized in that the dispensing assembly is a dispensing assembly according to the invention.

The aerosol preferably comprises a main container which is in communication with the inlet of one piston chamber, and an auxiliary container which is accommodated in the main container and is in communication with the inlet of the other piston chamber.

The invention will be explained in greater detail below with reference to the appended drawing:

DESCRIPTION OF THE PREFERRED EMBODIMENT

Figure 1:
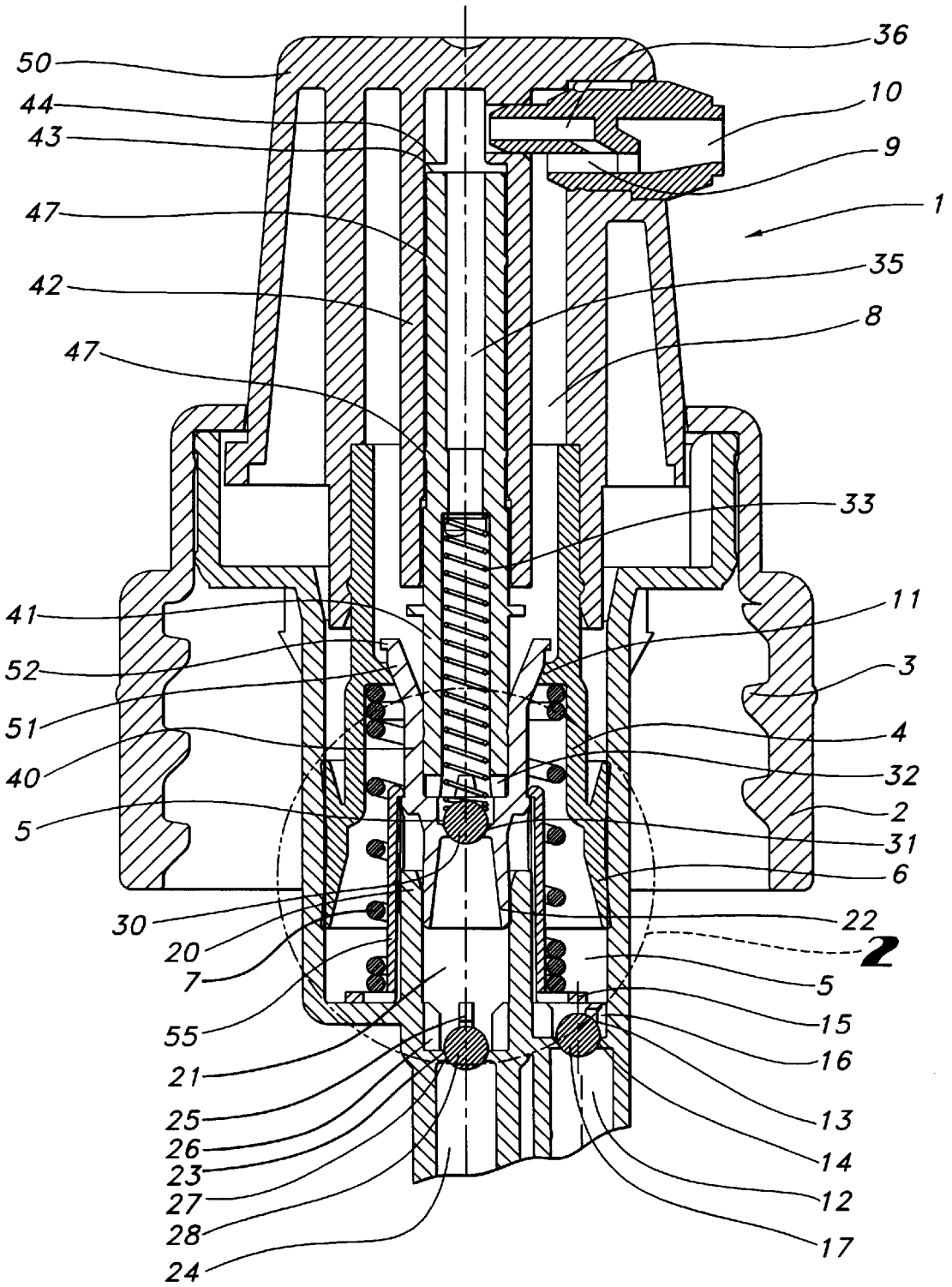
FIG. 1 shows a diagrammatic cross-section of a dispensing assembly according to the invention.

In FIG. 1 an embodiment of a dispensing assembly is indicated diagrammatically by reference number 1, which dispensing assembly can be fixed on a suitable container (not shown) by means of a fixing collar 2 comprising an internal screw thread 3.

Said dispensing assembly 1 comprises two concentric piston pumps, an outer piston pump 4 and an inner piston pump 20. The outer piston pump 4 will be discussed first of all. Said outer piston pump 4 comprises an outer piston chamber 5 and an outer piston 6. A spring 7 is present as the resetting means. Said piston chamber 5 can be placed in communication with an outflow channel 8 and by way of a channel 9 with an outflow opening 10. The outer piston 6, which is a hollow piston, also comprises a bevelled, inward directed collar 11.

The outer piston chamber 5 comprises an inlet 12 with a non-return valve 13, which non-return valve comprises a ball 17 accommodated between a seat 14, a flange 15 and ribs 16.

The inner piston pump 20 comprises an inner piston chamber 21 and a hollow inner piston 22. The inner piston chamber 21 comprises a non-return valve 23 in an inlet 24 for said chamber 21, which non-return valve 23 comprises a ball 28 disposed between lugs 25 on ribs 26 and a seat 27.

A non-return valve 29 is also present in the hollow piston 22, which non-return valve comprises a ball 30 accommodated between a seat 31 and a spring 33. Recesses are present between lugs 32, for an improved throughflow. By way of the non-return valve 29, the inner piston chamber 21 can be placed in communication with an outflow channel 35 which by way of a channel 36 is in communication with the outflow opening 10.

The inner piston 22 also comprises on the outside a bevelled collar 51 with a stop 52 which can interact with the bevelled, inward directed collar 11 on the outer piston 6.

The inner piston 22 comprises piston sections 40 and 41 combined to form a unit, and has a small free stroke relative to the other parts of the assembly, including the section 42. Said piston section 41 comprises a stop 43 which by interaction with a stop 44 on the control part 50 (a push-button) limits the movement of the piston 22. The section 41 is accommodated so that it glides, as it were telescopically, in the section 42 of the control part 50. For this purpose, the section 41 comprises circumferential protuberances 47, which provide for the seal of the two parts relative to each other.

The dispensing assembly 1 can be operated with the control part 50, for example by pressing with a finger thereon.

The dispensing assembly also comprises a stroke limiting part 55, which will be described further on with reference to FIG. 2, in which an enlarged detail of the encircled part A is shown.

Figure 2:
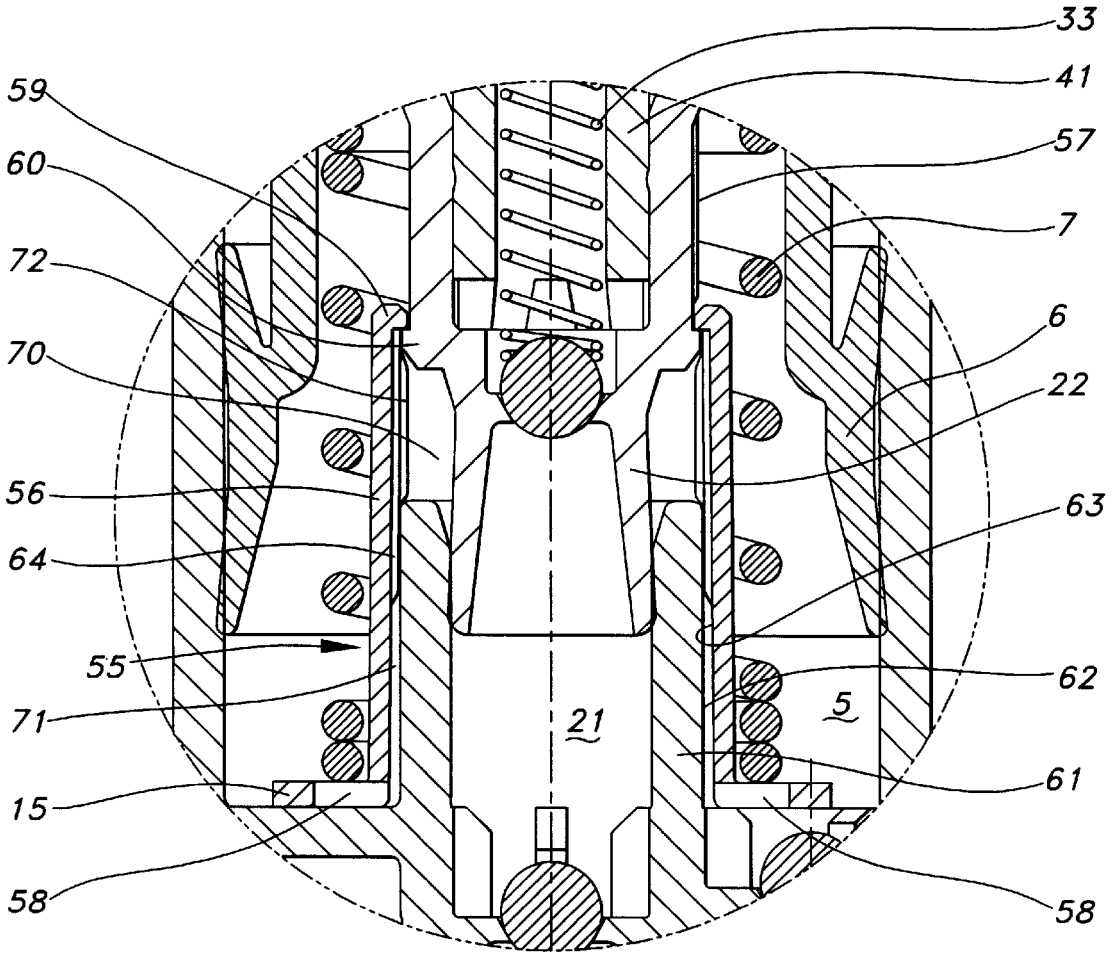
FIG. 2 shows an enlargement of a part A from FIG. 1.

As is clear from FIG. 2, the stroke limiting part 55 comprises a cylindrical bush 56 with a flange-shaped base 15, which rests on the bottom of the piston chamber 5, is provided locally with passages 58, and also serves to limit the movement of the ball 17. Said cylindrical bush 56 comprises on the top side an inward directed collar 59, which can interact with a stop 60 on the inner piston 22. The piston chamber 21 comprises a wall 61 with an outside 62, which outside is kept at a slight distance from the inside 63 of the cylindrical part 56 of the stroke limiting part 55 by ribs 64 present on said wall 63.

Reference number 70 indicates an intermediate piston chamber which is in communication with the piston chamber 5 by way of the channels 71 thus formed. At the position of the intermediate piston chamber 70, additional ribs 72, which serve to increase the friction between the stop 60 and the stroke limiting part 50 during movement of the inner piston 22, are present.

The stop 60 therefore serves as an intermediate piston for the intermediate piston chamber 70.

Friction ribs 57, which can interact with the stop 59 of the stroke limiting part 55, are preferably present on the outside wall of the section 40, instead of the ribs 72, or possibly in addition thereto.

The stroke limiting part 55 in practice will be made of a more rigid, harder plastic than the inner piston 22, and therefore the stop 60. At rest, the stop 60 is preferably not in contact with the friction ribs 72, in order to ensure that the friction is not removed by relaxation of the plastic of the stop 60.

The operation of the dispensing assembly 1 according to the invention will be explained in greater detail below.

As illustrated in FIGS. 1 and 2, the dispensing assembly 1 is in an initial position (rest position).

When being used, the dispensing assembly will be fixed on a container by means of the fixing collar 2, which container can comprise, for example, a main container which is connected to the inlet 12, and an auxiliary container which is preferably accommodated in the main container and is in communication with the inlet 24 for the inner piston chamber 21.

When the push-button 50 is pressed, for example by means of a finger, in the first instance the outer piston 6 is moved downwards and the seal between the bevelled collar 11 on the outer piston 4 and the bevelled collar 51 on the inner piston 22 is released, and material can flow out of the piston chamber 5 by way of the annular channel 8 to the outflow opening 10. The inner piston 22 moves with the section 41 into the section 42, which is integral with the push-button 50. This relative movement of the inner piston 22 is supported by the friction between the ribs 57 and the stop 59, and the friction between the stop 60 and the ribs 72. This continues until the stop 44 touches the stop 43, at which moment the inner piston is also moved downwards and material can also move out of the piston chamber 21 by way of the channel 35 to the outflow opening 10. This free stroke is preferably 0.2–0.4 mm. During this dispensing, material is conveyed out of the inner piston chamber by way of the channel 36 into the channel 9 of the material from the outer piston chamber 5, with the result that mixing occurs before a mixture is dispensed. It will be clear that two separate outflow openings or a differently designed mixing opening can also be used. A non-return valve or the like is preferably present between the channel 35 and the channel 9, said non-return valve serving to prevent material from the auxiliary container from being in communication with the environment in channel 35. In practice, the auxiliary container in fact often contains the so-called reactive component.

The non-return valve 29 will be opened by the pretension of the spring 33 only at a certain pressure in the piston chamber 21, and the non-return valve, which is formed by the two collars 11 and 51, is opened by the relative movement of the inner and outer piston respectively, which is promoted at the first stroke by friction between the stop 60 and the ribs 62 around the collar 59 and the ribs 57, but during use is taken over by the component sucked up into the piston chamber 70 from the piston chamber 5. In other words, the friction of the friction ribs is taken over by the damping action of the piston chamber 70.

When the push-button 50 is released after dispensing of material, the spring 7 will cause the assembly to move back to the initial position shown in the figures. At that moment the non-return valves 28 and 14 will be opened and material will be sucked out of the containers in question and into the piston chambers 5, 21 by way of the inlets 12 and 24. When the inner piston 22 moves back, the intermediate piston chamber 70 will be filled with material from the outer piston chamber 5 by way of channels 71 and the openings 58, but also by material passing through between the intermediate piston 60 and the ribs 64 and 72. For the next working stroke, the downward movement of the inner piston 22 will therefore be damped by the material which is present in the intermediate piston chamber 70 and is forced back by way of the narrow channels 71 to the piston chamber 5 and between the ribs 64 and 72, to the top side of the stop 60. The intermediate piston chamber 70 with the piston or stop 60 therefore acts as a damper on the movement of the inner piston 22. The effect of the friction ribs 72, 57 respectively and of the damping by the material present in the piston chamber 70 is particularly important during the return stroke.

In the return stroke the outer piston 6 will be moved upward first of all, and then, after the collar 11 has come into contact with the collar 51, the inner piston is moved upward along with them. The non-return valve formed by said collars 11, 51 is an active non-return valve, and the sealing thereof will be promoted by external partial vacuum, in other words a partial vacuum by way of the opening 10, the channel 9 and the channel 8.

It is advantageous if, prior to a first working stroke, the dispensing assembly at least in the piston chamber 21 contains a so-called primer or start-up agent which considerably shortens the start-up operation, in other words, reduces the number of times that pumping has to be carried out before material is dispensed. Accommodating the primer in the inner piston chamber 21 means that the number of start-up strokes of the outer pump can be made equal to that of the inner piston chamber. By also accommodating primer in the outer piston chamber 5, the number of start-up strokes of the outer pump can be reduced, but that means that in that case more primer must also be accommodated in the inner piston chamber 21.

An example of such a primer is glycerol. It is also advantageous if the intermediate piston chamber 70 and also the piston chamber 5 are filled with primer.

Figure 3:
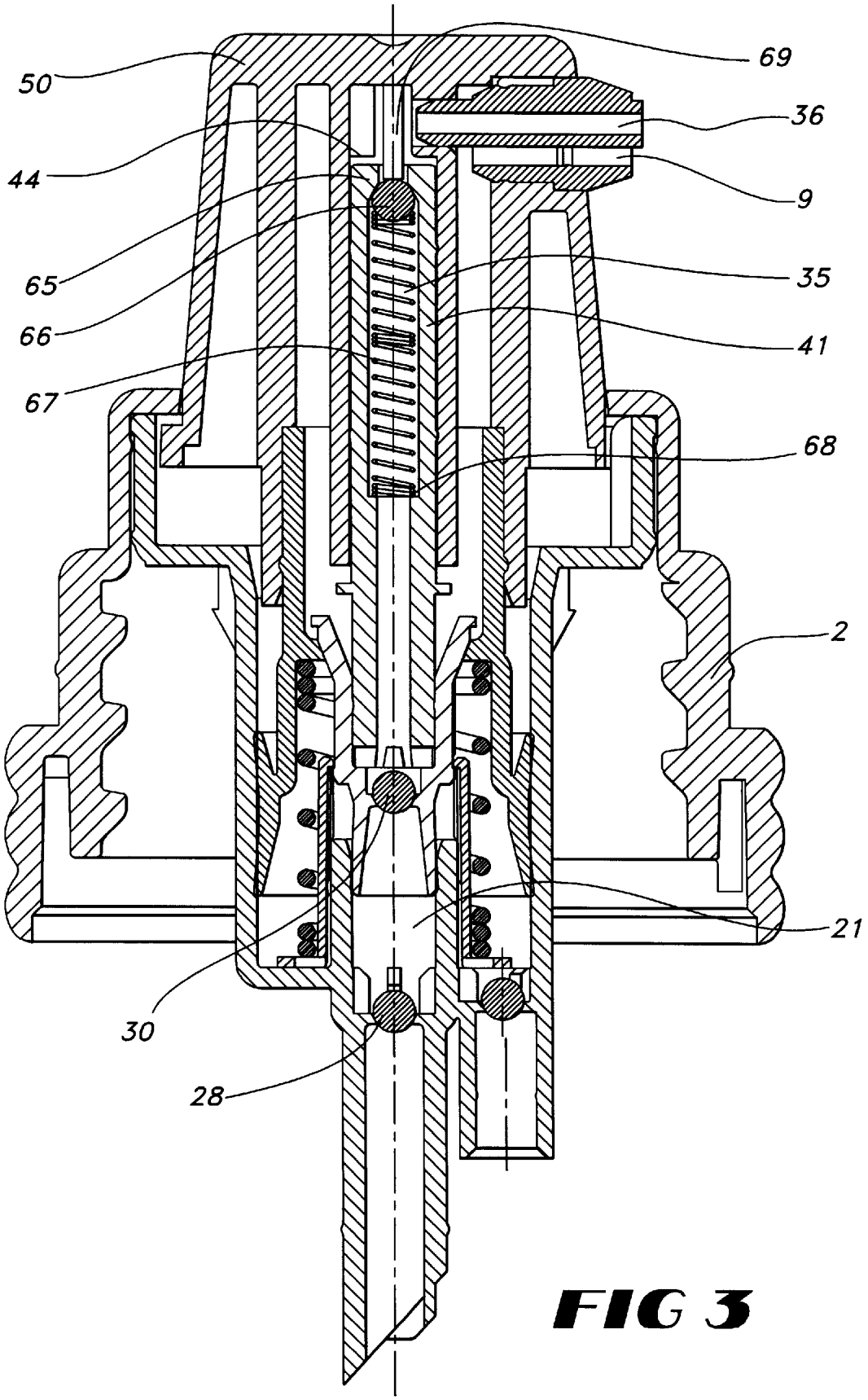
FIG. 3 shows a cross-section of a modified embodiment of a dispensing assembly according to FIG. 1.

The embodiment according to FIG. 3 largely corresponds to that according to FIG. 1. However, here the channels 36 and 9 are not in communication with each other and both open out into the environment. The piston section 41 comprises at the top end an inward directed collar 65, which serves as a seat for a ball 66 which is under pretension from a spring 67, which rests on a shoulder 68 in the section 41. The control button 50 comprises a pin 69 which has such measurements that when the control button 50 is pressed, said pin 69 forces the ball 66 off the seal, and the channel 35 can be placed in communication with the outflow channel 36.

The spring 33 from FIG. 1 in this case is no longer necessary, since the inner piston chamber 21 now comprises an active non-return valve in the end of the channel 35, in the form of a ball 66 which is under spring tension in the seat 65. Partial vacuum in the environment will seal the last-mentioned valve even better, with the result that it becomes impossible to suck material out of the inner piston chamber 21 and possibly out of the container in communication therewith. Remaining material in the channel 35 cannot come into contact with the environment either. Such material is frequently an active component.

The spring 67 preferably has a relatively low spring force, for it must be ensured that at the start of dispensing, i.e. when the control button 50 is pressed, the ball 66 is first lifted off the seat 65 before other non-return valves are opened or the pistons of the pumps in question are moved in the piston chambers.

Figure 4:
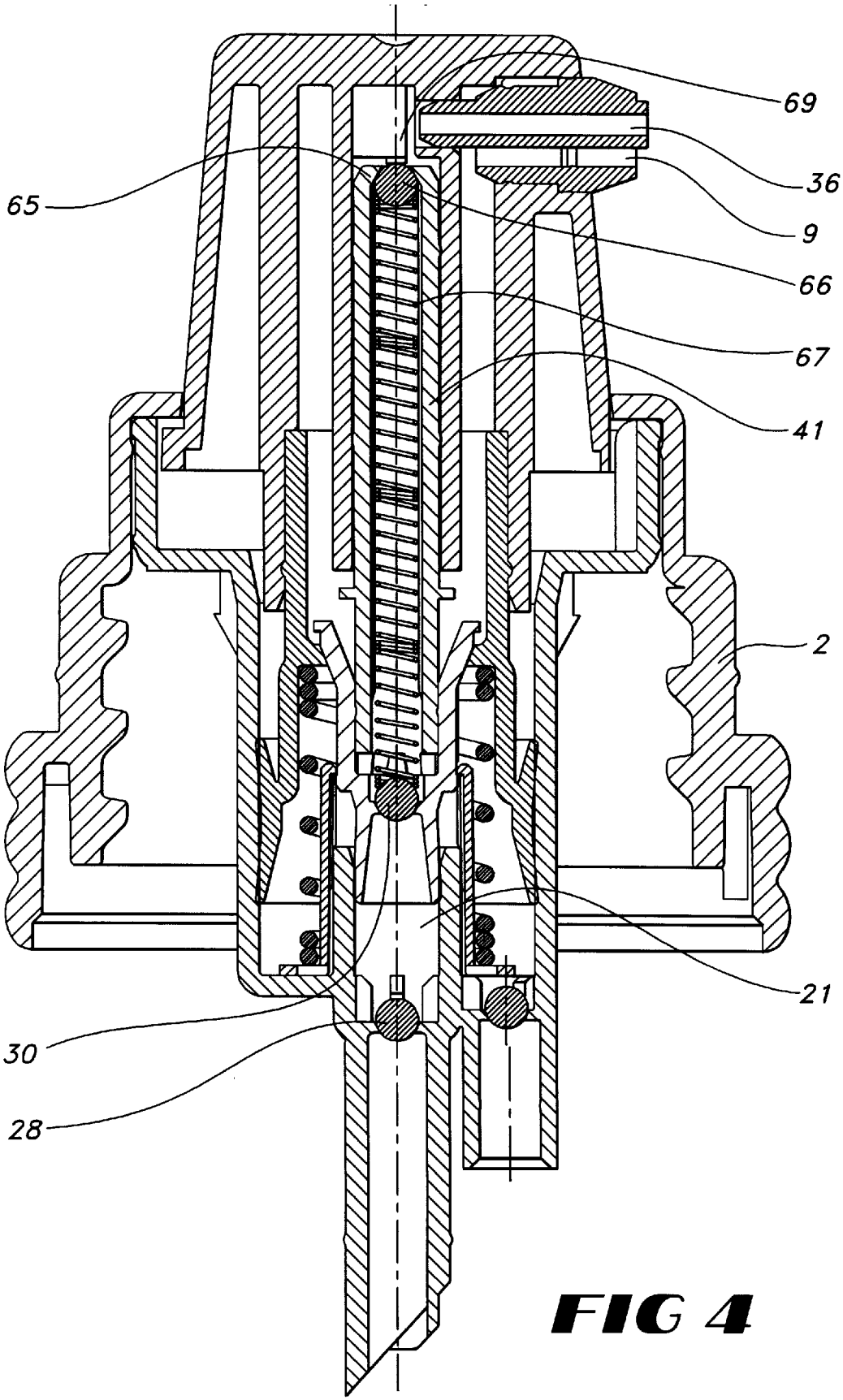
FIG. 4 shows a modified embodiment of the dispensing assembly according to FIG. 3.

A particularly preferable embodiment of the spring 67 is shown in FIG. 4, in which embodiment the dispensing assembly for the rest is identical to that of FIG. 3. The spring 67 in this case is a dual-action spring. It is made so long that it serves as a pre-tensioning means both for the ball 66 and for the ball 30. An additional advantage is that the shoulder 68 can be omitted here, which in FIG. 3 in combination with the seat 65 constitutes an injection moulding problem for the section 41, since there is in fact a problem with removal from the mould which is to be used for the purpose. This problem does not arise in the case of the embodiment according to FIG. 4.

All parts of the dispensing assembly according to the present invention in practice can be made of suitable plastic. However, the balls and springs are generally made of metal.

What is claimed is:

1. Dispensing assembly for dispensing two liquid components, comprising an outer piston pump concentric with an inner piston pump for the components to be dispensed, with a common control part, which piston pumps are provided with resetting means, and each comprise a piston chamber with a piston and an inlet and an outlet, which outlet can be placed in communication with an outflow opening, with the interposition of a non-return valve under pre-tension, and which inlet can be placed in communication with a source for component to be dispensed, with the interposition of a non-return valve, while the pistons of the piston pumps comprise a channel for conveying the liquid component in question to an outflow opening, wherein the inner piston pump comprises the inner piston which has a small free stroke relative to the other parts of the assembly, in that a stationary stroke limiting part with a stop is present in the outer piston chamber of the outer piston pump, which stroke limiting part under friction can interact with a stop on the inner piston, in order to limit the movement distance thereof and permit the movement thereof only under friction, and in that the outer piston and the inner piston comprise carrier means which can interact in a sealing manner with each other and form an active non-return valve for the outlet of the outer piston chamber, the assembly reacts in such a way that when there is a resetting movement the outer piston can carry along the inner piston and seal the communication between the outer piston chamber and the outflow opening.

2. Dispensing assembly according to claim 1, wherein the stationary stroke limiting part defines an annular intermediate piston chamber which by way of one or more narrow passages is in communication with the outer piston chamber, and in that the stop on the inner piston forms an intermediate piston in the intermediate piston chamber.

3. Dispensing assembly according to claim 2, wherein the stroke limiting part is formed by a bush fixed on the inner piston chamber and having on one end an inward directed collar which can interact with the intermediate piston, in which ribs on at least one side of the inside wall of the bush or the outside wall of the inner piston chamber, one or more passages are formed, so that the intermediate piston chamber is in communication with the outer piston chamber.

4. Dispensing assembly according to claim 1, wherein at least the inner piston chamber is filled with a start-up agent prior to a first use of the dispensing assembly.

5. Dispensing assembly according to claim 1, wherein the carrier means on the inner piston and the outer piston are designed in the form of sealing collars on said pistons, which collars are bevelled in the same direction and fit into each other.

6. Dispensing assembly according to claim 1, wherein the outside wall of the inner piston is provided locally with friction ribs which extend in the intended direction of movement of the inner piston, but are situated at a distance from the stop thereof, which distance is equal to or greater than the axial distance of the stop from the stroke limiting part.

7. Dispensing assembly according to claim 1, wherein the free stroke of the inner piston is such that it is just sufficient to be able to release the carrier means on the inner piston and the outer piston and open the communication between the outer piston chamber and a dispensing opening.

8. Dispensing assembly according to claim 1, wherein the non-return valve in the outlet of the inner piston chamber is designed in the form of a ball pre-tensioned by a spring in a seat.

9. Dispensing assembly according to claim 1, wherein the inner piston, which relative to the other parts of the assembly has a small free stroke at the outflow end, comprises a valve which is pre-tensioned in the outflow direction, which valve can be opened by interaction with the control part.

10. Dispensing assembly according to claim 9, wherein said outflow end of the inner piston comprises an inward directed collar which forms a seat for a ball present in the piston, which ball is held in the seat by a spring, and in that the control part comprises a bar-shaped part which during the dispensing of material can press the ball off the seat against the action of the spring.

11. Aerosol, comprising two compartments for components and a dispensing assembly, wherein the dispensing assembly is a dispensing assembly according to claim 1.

12. Aerosol according to claim 11, wherein the aerosol comprises a main container which is in communication with the inlet of one piston chamber, and an auxiliary container which is accommodated in the main container and is in communication with the inlet of the other piston chamber.

* * * * *